US009199507B2

(12) United States Patent
Davies-Smith et al.

(10) Patent No.: US 9,199,507 B2
(45) Date of Patent: Dec. 1, 2015

(54) WRITING INSTRUMENT AND INK CARTRIDGE UNIT

(75) Inventors: Leighton Davies-Smith, Founex (CH); David Martin, Glynde Nr Lewes (GB); Pascal Fruchet, Nantes (FR)

(73) Assignee: Europe Brands S.à.r.l., Luxembourg (LU)

( * ) Notice: Subject to any disclaimer, the term of this patent is extended or adjusted under 35 U.S.C. 154(b) by 462 days.

(21) Appl. No.: 13/698,948

(22) PCT Filed: May 20, 2011

(86) PCT No.: PCT/US2011/037278
§ 371 (c)(1),
(2), (4) Date: Nov. 19, 2012

(87) PCT Pub. No.: WO2011/146797
PCT Pub. Date: Nov. 24, 2011

(65) Prior Publication Data

US 2013/0064597 A1 Mar. 14, 2013

(30) Foreign Application Priority Data

May 20, 2010 (EP) ..... 10005299

(51) Int. Cl.

| | |
|---|---|
| ***B43K 1/02*** | (2006.01) |
| ***B43K 1/00*** | (2006.01) |
| ***B43K 5/00*** | (2006.01) |
| ***B43K 5/02*** | (2006.01) |
| ***B43K 7/02*** | (2006.01) |
| ***B43K 8/03*** | (2006.01) |
| ***B43K 17/00*** | (2006.01) |
| ***B43K 23/12*** | (2006.01) |

(52) U.S. Cl.
CPC . *B43K 1/02* (2013.01); *B43K 1/003* (2013.01); *B43K 5/00* (2013.01); *B43K 5/02* (2013.01); *B43K 7/02* (2013.01); *B43K 8/03* (2013.01); *B43K 17/005* (2013.01); *B43K 23/128* (2013.01)

(58) Field of Classification Search
CPC combination set(s) only.
See application file for complete search history.

(56) References Cited

U.S. PATENT DOCUMENTS 881,215 A * 3/1908 Wurdemann ..... 401/231
2,619,070 A 11/1952 Baker (Continued)

FOREIGN PATENT DOCUMENTS

CN 85200738 U 7/1986
CN 2373273 Y 4/2000

(Continued)

OTHER PUBLICATIONS

English translation of Office Action for corresponding Chinese Patent Application No. 201180024759.8, dated Jun. 27, 2014.

(Continued)

*Primary Examiner* — David Walczak
(74) *Attorney, Agent, or Firm* — Marshall, Gerstein & Borun LLP

(57) ABSTRACT

A writing instrument includes a shell, an ink reservoir disposed in the shell and a writing tip section that is provided on the shell from which ink from the ink reservoir is applied to a substrate. The writing tip section includes a writing tip and an ink feed assembly for delivering ink from the ink reservoir to the writing tip through capillary action. The writing tip is flexible and a flexible cover with the shape of a fountain pen nib is provided for supporting the flexible writing tip.

21 Claims, 14 Drawing Sheets

(56) References Cited

U.S. PATENT DOCUMENTS

| | | | | |
|---|---|---|---|---|
| 2,871,825 | A | 2/1959 | Uchida et al. | |
| 3,203,403 | A * | 8/1965 | Yanagita et al. | 401/108 |
| 3,645,636 | A * | 2/1972 | Mutschler | 401/227 |
| 4,347,011 | A * | 8/1982 | Yanagita | 401/31 |
| 5,290,117 | A | 3/1994 | Yokosuka et al. | |

FOREIGN PATENT DOCUMENTS

| | | | |
|---|---|---|---|
| CN | 201338451 | Y | 11/2009 |
| FR | 577460 | A | 9/1924 |
| GB | 194879 | A | 3/1923 |
| JP | H07-37905 | | 8/1995 |
| WO | WO-00/64688 | A1 | 11/2000 |
| WO | WO-2004/082963 | A1 | 9/2004 |
| WO | WO-2008/007167 | A1 | 1/2008 |

OTHER PUBLICATIONS

Extended European Search Report for corresponding European application No. 10005299.2, dated Nov. 22, 2010.

International Search Report and Written Opinion from corresponding International Application No. PCT/US2011/037278, mailing date Nov. 17, 2011.

English translation of Office Action for corresponding Japanese Patent Application No. 2013511372, dated Apr. 7, 2015.

* cited by examiner

WRITING INSTRUMENT AND INK CARTRIDGE UNIT

FIELD OF THE INVENTION

The present invention relates generally to a writing instrument and more specifically to a writing instrument having a writing tip section that simulates a look and feel of a fountain pen.

BACKGROUND

Consumer test data show that fountain pens are considered to be the quintessential fine writing instrument. However, there are certain "barriers to entry" that often prevent consumers from continuously utilizing the fountain pen category. These barriers include scratchiness of the nib, lack of durability of the nib, other perceived complications of use such as messiness, leakage, etc. As a result, while certain consumers may aspire to use fine writing instruments, they are often hesitant to commit to continuously utilize the fountain pen because of the aforementioned barriers to entry.

SUMMARY

A writing instrument that mimics or simulates a look and feel of a fountain pen includes a shell, an ink reservoir disposed in the shell and a writing tip section that is provided on the shell with which ink from the ink reservoir may be applied to a substrate. The writing tip section includes a writing tip and an ink feed assembly for delivering ink from the ink reservoir to the writing tip through capillary action, in particular by way of a capillary ink feed duct. The writing tip is flexible and a flexible cover with the shape of a fountain pen nib is provided adjacent to the writing tip to support the flexible writing tip when the flexible writing tip is subject to writing forces.

In another embodiment a writing instrument includes a shell, a chamber in the shell for accommodating an ink cartridge and a writing tip section that it is provided on the shell with which ink from the ink cartridge may be applied to a substrate. The writing tip section includes a writing tip and an ink feed assembly for delivering ink from the ink cartridge to the writing tip through capillary action, in particular by way of a capillary ink feed duct. A spring element is disposed in the shell at an end thereof opposite to the writing tip. The spring element biases the ink cartridge axially within the shell.

In yet another embodiment, an ink cartridge unit for a writing instrument includes an ink reservoir and a writing tip section with which ink from the ink reservoir may be applied to a substrate. The writing tip section includes a flexible writing tip and a flexible cover with the shape of a fountain pen nib for supporting the flexible writing tip. An ink feed assembly duct delivers ink from the ink reservoir to the flexible writing tip, through capillary action. The ink reservoir may be integrally formed with the shell or defined by an ink cartridge. The flexible cover is flexible in a radial direction and may be formed of plastic or metal. The flexible cover may be part of the shell, or connected to the ink cartridge.

In another embodiment, the flexible writing tip is made of plastic. More particularly, the flexible writing tip may be made from any one or a combination of copolymers and homopolymers, with copolymers providing a smooth feel and homopolymers offering a wear-resistant hard writing touch. Traditional fountain pen nibs have a straight "slit" pathway for the ink. Because the slit is open on a bottom and a top of the fountain pen nib, ink within the slit is exposed to air and thus prone to drying and clogging. The disclosed plastic tips have an enclosed pathway (ink feed duct), which prevents ink exposure thus reducing ink drying and clogging.

According to another embodiment, the ink cartridge is part of a removable unit. In some cases the removable unit may be disposable. In other cases, the ink cartridge may be reusable and/or refillable.

The disclosed writing instrument mimics the visual look of a fountain pen (e.g. a nib that is aesthetically appealing), and the positive feel attributes of a traditional fountain pen (e.g., a more durable tip with bit of writing "bite", but not scratchy) but with the convenience of a rollerball, an extruded plastic tip, or any other porous or non-porous system that is not a fountain pen nib. Advantages of the disclosed writing instrument include being less prone to leakage, ease of refilling, and simplicity of operation. The disclosed writing instrument is a pseudo fountain pen for those that prefer fountain pens, but on occasion need the convenience of a rollerball, an extruded plastic tip, or any other non fountain pen porous or non-porous tip. Moreover, the disclosed writing instrument may attract would-be fine writing instrument users who were previously daunted by the thought of using fountain pens.

BRIEF DESCRIPTION OF THE DRAWINGS

Features and advantages of the present invention will follow from the accompanying claims and the following description when reading in combination with the drawings, in which:

DETAILED DESCRIPTION

Figure 1:
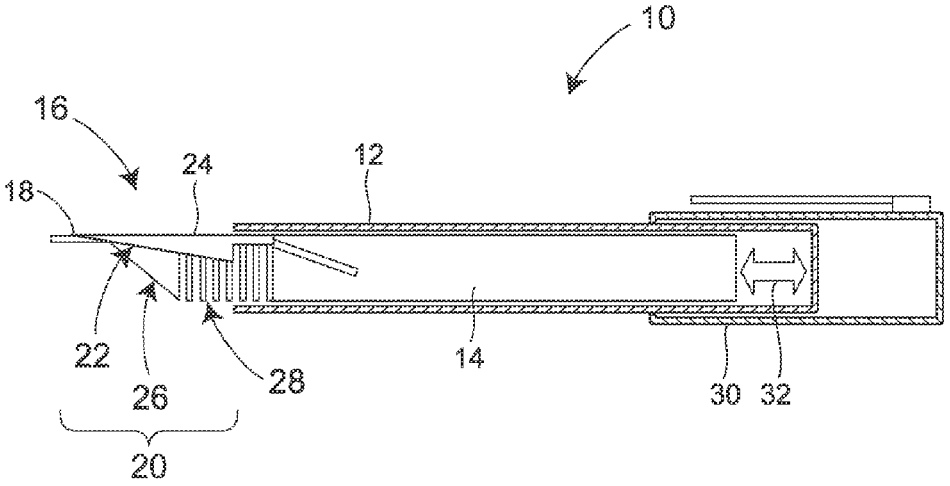
FIG. 1 is a side view of one embodiment of a writing instrument constructed in accordance with the disclosure.

FIG. 1 illustrates one embodiment of a writing instrument 10 comprising a barrel or shell 12, an ink cartridge 14 including an ink reservoir, the ink cartridge 14 being disposed in a hollow chamber in the barrel or shell 12, and a writing tip assembly or writing tip section 16 disposed at an open end of the barrel or shell 12. The barrel or shell 12 is formed from two pieces to allow for the insertion of the ink cartridge 14. Ink from the ink cartridge 14 is supplied to a writing tip section 16 via an ink feed assembly or ink delivery system 20 through capillary action. A writing point or tip 18 is disposed at one end of the writing tip section 16 and may be flexible and made of plastic. The ink feed assembly 20 includes a capillary ink feed duct 22 made by, for example, cross-section molding. Extrusion can be used to mold engineering plastic with a precisely controlled interior cavity or lumen. In other embodiments, the writing tip 18 may be formed of other materials, such as metal, extruded plastic, or any other porous or non-porous material. A flexible cover 24 with the shape of a traditional fountain pen nib is disposed adjacent to the flexible writing tip 18. The flexible cover 24 supports the flexible writing tip 18 or otherwise resists radial forces generated when the writing tip 18 contacts a substrate. The flexible cover 24 is disposed above or at least partially around the writing tip 18, as illustrated in FIG. 1.

The ink feed assembly 20 further comprises a feed 26 and a collector 28. The feed 26 and collector 28 may be ornamental only and the capillary ink feed duct 22 may be the only functional component of the ink feed assembly 20. The ink feed assembly is not complex. The feed 26 and/or the collector 28 exhibit built-in flexibility for upward movement.

The writing instrument 10 may be equipped with a cap 30. The cap 30 may be removably disposed at either end of the shell 12.

Within the shell 12 and at one end of the shell 12, opposite to the writing tip section 16, a spring element 32 (shown by a double arrow) is disposed for biasing the ink cartridge 14 axially within the shell 12. As a result, the writing tip section 16 is movable axially towards and away from the spring element 32. The spring element 32 provides a cushioning effect that further simulates the feel of a fountain pen during writing. In some embodiments, the spring element 32 may have a spring force of between about 300 and about 500 grams to provide a better writing feel.

Figure 2:
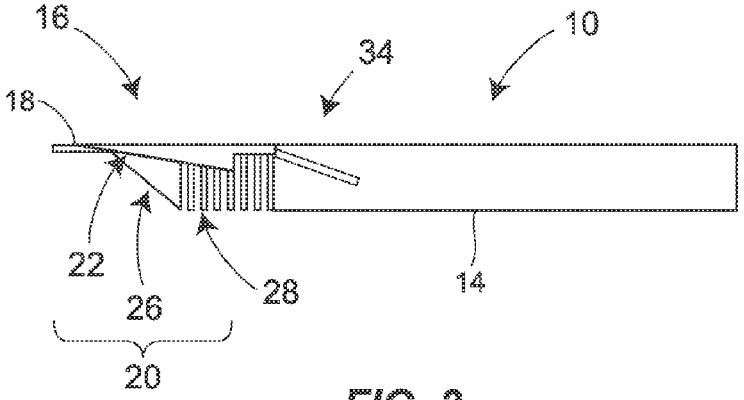
FIG. 2 is a side view of the writing instrument of FIG. 1 without a cap and spring.

FIG. 2 illustrates the writing tip section 16 and the flexible cover 24 as a removable and disposable unit. A disposable unit can provide a disposable cover that is more flexible than a permanent cover due to the limitations of the lifespan of the flexible parts. The disposable unit could be also called a complete refill. Alternatively, the writing tip section 16 and flexible cover 24 may be designed as a reusable or refillable unit.

Figure 3:
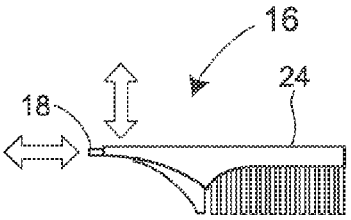
FIG. 3 is a side view of a writing tip section of the writing instrument of FIG. 1.

FIG. 3 illustrates potential movement directions (see double arrows) of the writing tip 18 during writing. When the writing tip 18 is placed on a substrate, the writing tip 18 moves axially towards the spring element 32, which cushions contact between the writing tip 18 and the substrate. While the spring element 32 shown in FIGS. 1 and 2 provides for additional axial writing flexibility, the cover 24 provides for flexible resistance in a radial direction during writing to mimic the feel of a traditional fountain pen nib.

The cover 24 can be a spring-loaded metallic hinged section with the shape of a nib or a metal nib-like feature with in-built spring modulus.

The writing tip 18 may be formed by extruding plastic to provide smooth writing. Ink used may be similar to fountain pen ink (low dyestuff content, water-based, surface tension around 40-50 dyne/cm).

The writing tip 18 may be virtually any type of writing point or tip including, but not limited to, ball points (such as those for use in ball point systems, roller ball systems, and gel systems), porous points, such as extruded plastic tips (suitable for use in markers), and other non-fountain pen porous or non-porous points.

Figure 4:
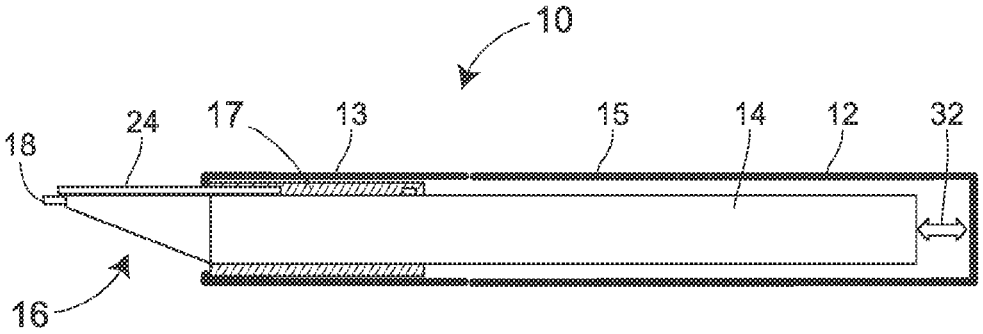
FIG. 4 is a cross-sectional side view of another embodiment of a writing instrument constructed in accordance with the disclosure, a writing cartridge being positioned axially forward.
Figure 5:
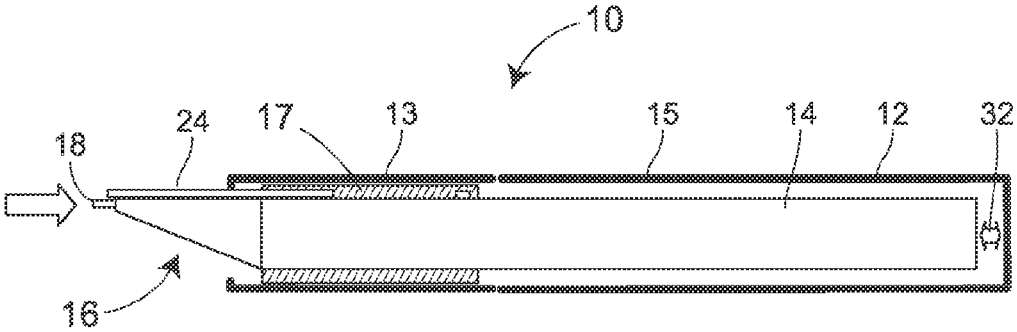
FIG. 5 is a cross-sectional side view of the writing instrument of FIG. 4 with the writing cartridge being positioned axially rearward.
Figure 6:
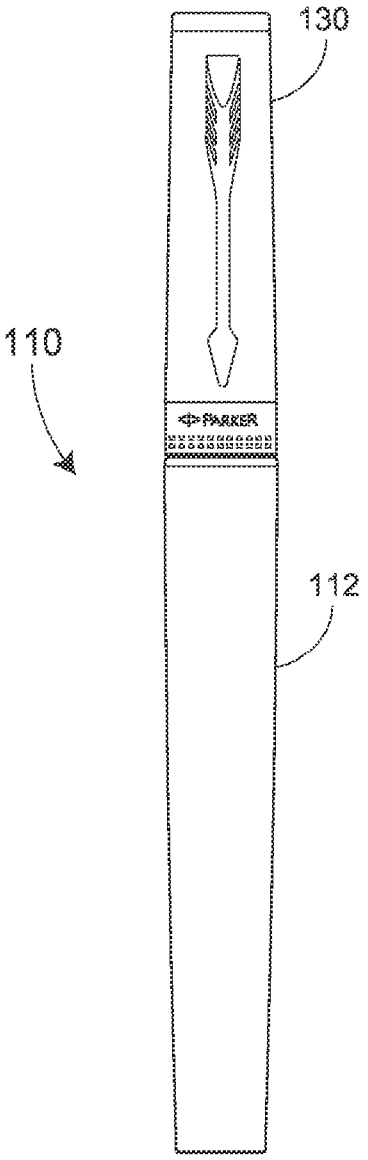
FIG. 6 is a top view of another embodiment of a writing instrument constructed in accordance with the disclosure, the writing instrument having a cap over a writing end.
Figure 7:
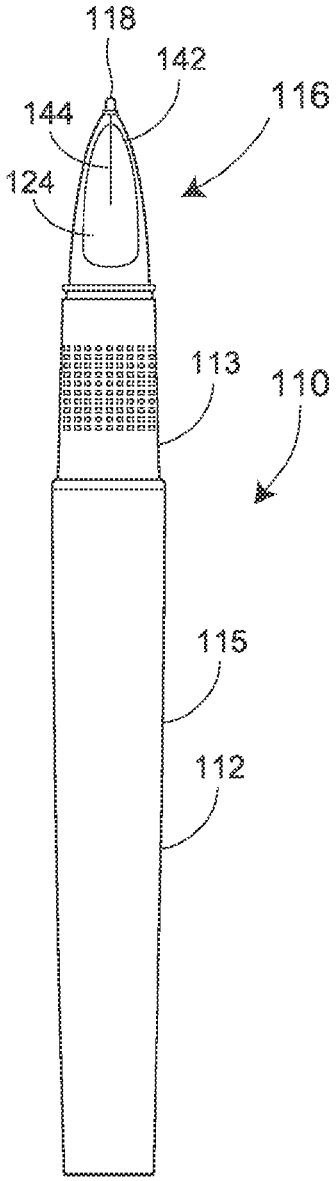
FIG. 7 is a top view of the writing instrument of FIG. 6 with the cap removed from the writing end.
Figure 8:
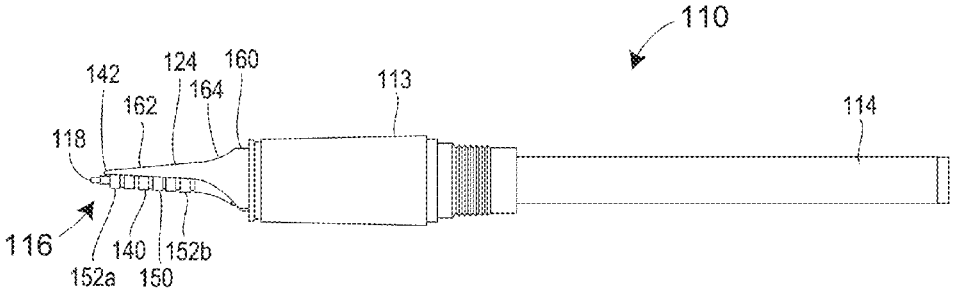
FIG. 8 is a side view of the writing instrument of FIGS. 6 and 7 with an aft barrel section removed.
Figure 9:
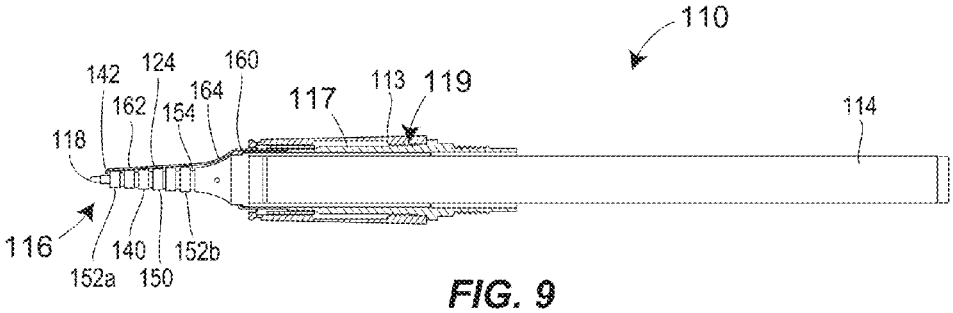
FIG. 9 is a cross-sectional side view of the writing instrument of FIG. 8.
Figure 10:
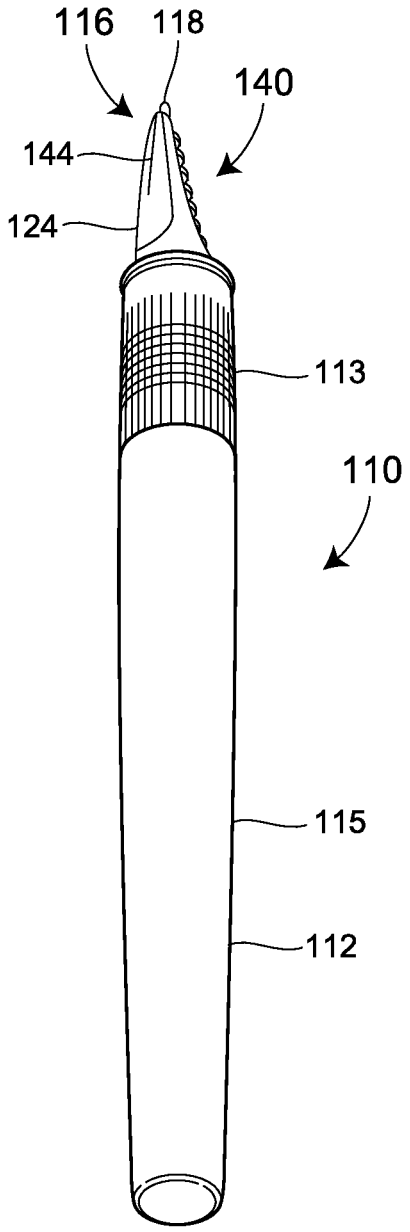
FIG. 10 is a perspective view of the writing instrument of FIGS. 6 and 7 including a writing tip assembly.
Figure 11:
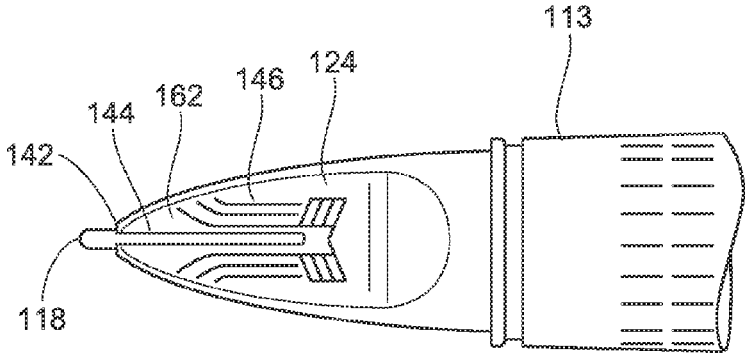
FIG. 11 is a close up top view of the writing tip assembly of FIG. 10.
Figure 12:
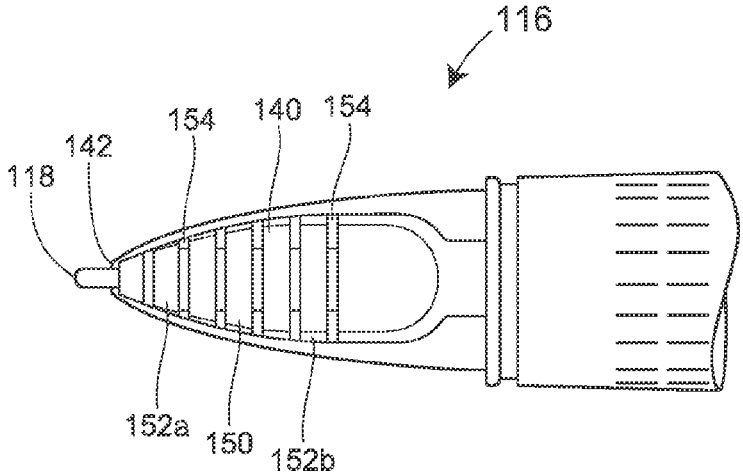
FIG. 12 is a close up bottom view of the writing tip assembly of FIG. 10.

Turning now to FIGS. 4 and 5, the barrel or shell 12 may be formed from two pieces to allow for the insertion of the ink cartridge 14, a front piece 13 of the barrel or shell, and a back piece 15 of the barrel or shell. An inner sheath 17 may be disposed between the front piece 13 and the cartridge 14. The cover 24 may be mounted to the inner sheath 17 in some embodiments. In other embodiments, the inner sheath 17 may include orientation features that interact with the cartridge 14 to ensure proper alignment of the cartridge 14 within the barrel 12. The inner sheath 17 advantageously allows the cover 24 and inner sheath 17 to be pre-assembled as a sub-assembly, thus facilitating customization of the barrel 12 and/or final assembly where parts of the writing instrument are manufactured in different locations.

FIGS. 6-12 illustrate another embodiment of a writing instrument 110. The writing instrument 110 includes a barrel or shell 112 including a front piece 113 and a back piece 115, and a writing tip assembly 116. The writing instrument 110 mimics or simulates a fountain pen in both appearance and operation. More specifically, the flexible cover 124 takes on a generally arrowhead-shape when viewed from above, especially apparent in FIGS. 7 and 11. This arrowhead-shape is very similar to fountain pen nib shapes. Moreover, the flexible cover 124 and front piece 113 may be formed from metal, or be covered with a metallic colored coating to further mimic the ornate appearance of a fountain pen.

The flexible cover 124 supports an ink delivery portion 140 of the writing tip assembly 116 during the writing process. The flexible cover 124 may be cantileverly attached to the inner sheath 117 so that a distal end 142 of the flexible cover 124 is displaceable in a radial (i.e., lateral, or transverse to a longitudinal axis of the writing instrument) direction. The inner sheath 117 may be attached to the front piece 113 of the barrel 112 at a threaded connection 119. In other embodiments, the inner sheath 117 may be secured to the front piece 113 by, for example, adhesives, press fitting, fasteners, or virtually any other type of attachment. In the embodiment of FIGS. 6-12, a portion of the flexible cover 124 is disposed between the inner sheath 117 and the front piece 113 of the barrel 112. However, in other embodiments, the flexible cover 124 may be directly connected to, or integrated with, either the writing tip assembly 116 or the barrel 112. While being flexible, the flexible cover 124 is more rigid than the ink delivery portion 140. Thus, the flexible cover 124 provides at least some resistance to radial displacement of the ink delivery portion 140 and writing point 118. The amount of resistance produced by the flexible cover 124 roughly approximates the radial resistance produced by a fountain pen nib.

Turning now to FIGS. 7-11, the flexible cover 124 may include a longitudinal slit 144 extending from the proximal end 142 towards the cartridge 114. The longitudinal slit 144 produces the visual appearance of a fountain pen nib. Moreover, the longitudinal slit 144 can improve the flexibility characteristics of the flexible cover 124 in some embodiments, but adds little or no flexibility in other embodiments. The writing point 118 may be parallel to, and longitudinally aligned with, the longitudinal slit 144 to further simulate a fountain pen nib appearance. The flexible cover 124 may include one or more flexibility features 146, such as grooves or ridges, to adjust or modify flexibility characteristics of the flexible cover 124.

Referring to FIGS. 8-12, the ink delivery portion 140 is positioned beneath the flexible cover 124. The ink delivery portion 140 includes an outer sleeve 150 that is discontinuous and formed from a plurality of radial segments 152. The radial segments 152 are separated from one another by a plurality of gaps 154 (which may or may not extend completely to the inner sleeve 170, see FIG. 14). The radial segments 152 and gaps 154 combine to give the ink delivery portion 140 flexibility in the radial direction. Moreover, the radial flexibility is variable along the length of the ink delivery portion 140. In other words, the ink delivery portion 140 is more flexible near the writing point 118 than near the cartridge 114. The variable flexibility can be produced by varying the radial size (i.e., the radial thickness) of the radial segments 152 while having gaps 154 of the same size. More specifically, a radial segment 152*a*, proximate the writing point 118, can have a smaller radial size or thickness than a radial segment 152*b*, distal to the writing point 118. Thus, the ink delivery portion 140 can deflect farther near the writing point 118 than distal to the writing point 118 before the radial segments 152 contact one another to resist further defection. In a first alternative embodiment, the variable flexibility can be produced by having radial segments 152 of uniform radial size and varying the size of the gaps 154 (such that the size of the gaps is greater proximate the writing point 118 than distal to the writing tip). In a second alternative embodiment, the gaps 154 could have a uniform size and the radial segments 152 could have a uniform radial size to thickness while varying a longitudinal or axial thickness of the radial segments 152 to generate the variable flexibility of the ink delivery portion 140.

The flexible cover 124 includes a mounting portion 160 and a substantially flat resistance portion 162 connected by a radiused juncture 164. The radiused juncture 164 allows the substantially flat resistance portion 162 to flex in the radial direction during writing. The substantially flat resistance portion 162 supports the writing assembly 116, and more specifically the ink delivery portion 140, during writing. The combination of the radiused juncture 164 and the substantially flat resistance portion 162 result in a writing feel that mimics a traditional fountain pen nib.

Figure 13:
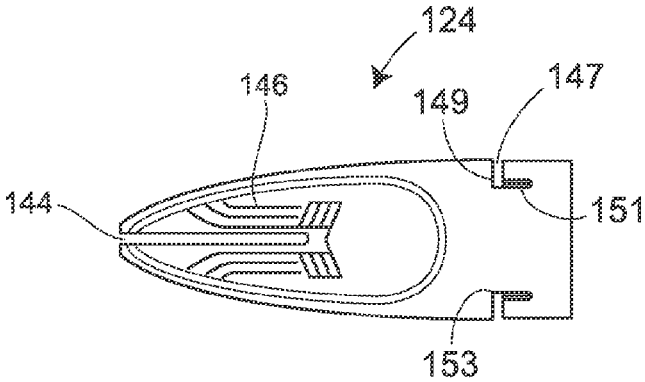
FIG. 13 is a close up top view of a flexible cover of the writing tip assembly of FIG. 10.

FIG. 13 illustrates one alternative embodiment of the flexible cover 124. In this embodiment, the flexible cover includes two radial slits 147. The radial slits 147 include a radial portion 149 and a longitudinal portion 151. The radial portion 149 and the longitudinal portion 151 are joined at a radius 153. The radial slits 147 improve flexibility characteristics of the cover 124 when used in combination with a writing tip assembly 116, in addition to directing internal stresses in the cover 124 more efficiently.

Figure 14:
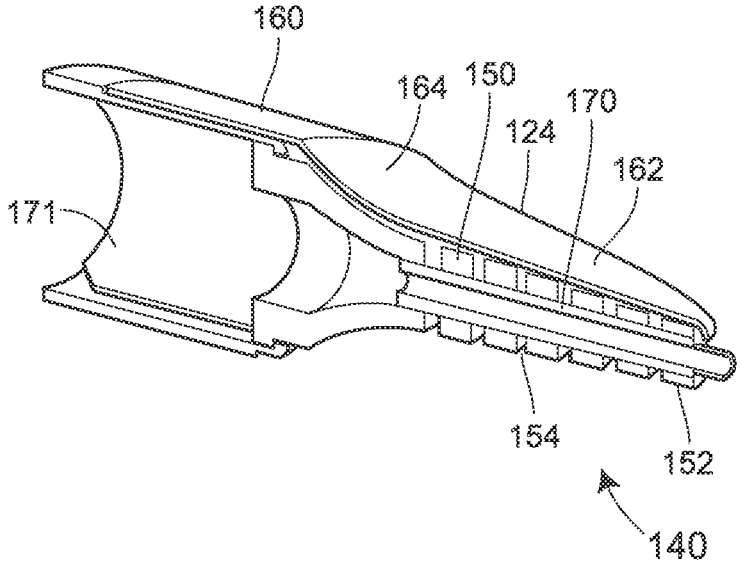
FIG. 14 is a cross-sectional perspective view of the writing tip assembly of FIGS. 11 and 12.
Figure 15:
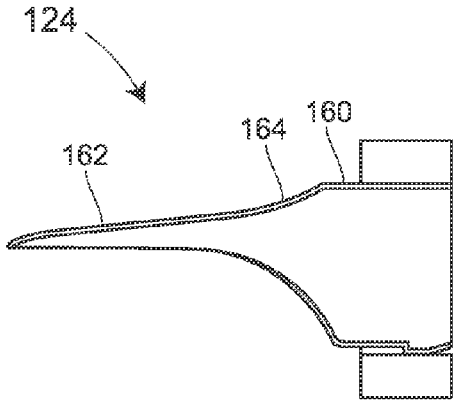
FIG. 15 is a close up side cross-sectional view of an alternate embodiment of a flexible cover.
Figure 16:
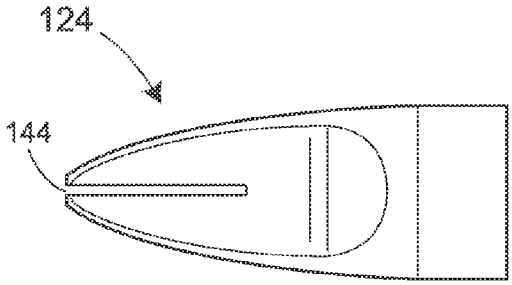
FIG. 16 is a close up top view of the flexible cover of FIG. 15.
Figure 17:
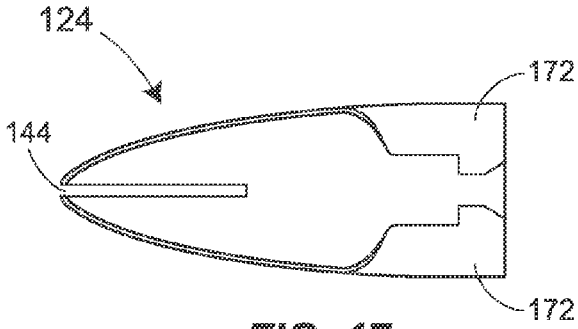
FIG. 17 is a close up bottom view of the flexible cover of FIG. 15.
Figure 18:
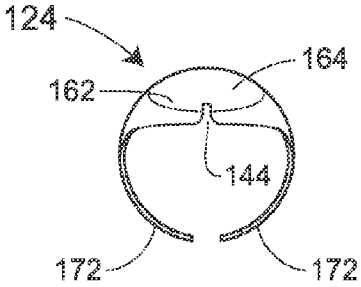
FIG. 18 is a close up front view of the flexible cover of FIG. 15.

Turning now to FIG. 14, the ink delivery portion 140 is illustrated in more detail. The ink delivery portion 140 includes an inner sleeve 170 that forms a substantially continuous capillary ink delivery channel between the ink reservoir 171 and the writing point 118. Ink from the ink reservoir 171 flows through the inner sleeve 170 and to the writing point 118 under capillary pressure and is not exposed to the atmosphere until the ink exits the writing point. The inner sleeve 170 fully encloses the ink during travel from the ink reservoir 171 to the writing point 118. Thus, ink in the ink delivery portion 140 is not susceptible to drying or clogging. The inner sleeve 170 is structurally reinforced by the discontinuous outer sleeve 150. Both the inner sleeve 170 and the outer sleeve 150 are somewhat flexible. As discussed above, the outer sleeve 150 includes a plurality of radial segments 152 that impart varying flexibility to the ink delivery portion 140. The flexible cover 124 is disposed adjacent to at least a part of the outer sleeve 150.

FIGS. 15-18 illustrate one embodiment of the flexible cover 124. As discussed above, the flexible cover 124 includes the mounting portion 160 and the substantially flat resistance portion 162 connected by the radiused juncture 164. This combination provides both radial flexibility and radial support to the writing assembly 116. The longitudinal slit 144 provides the appearance of a fountain pen nib, and in some embodiments similar flexibility characteristics to a fountain pen nib. The flexible cover 124 also includes a pair of downwardly extending arms 172. The downwardly extending arms 172 secure the inner sheath 117 therebetween to provide lateral stability to the inner sheath 117 and ink delivery portion 140 during writing and to help protect the ink delivery portion 140 from environmental factors.

Figure 19:
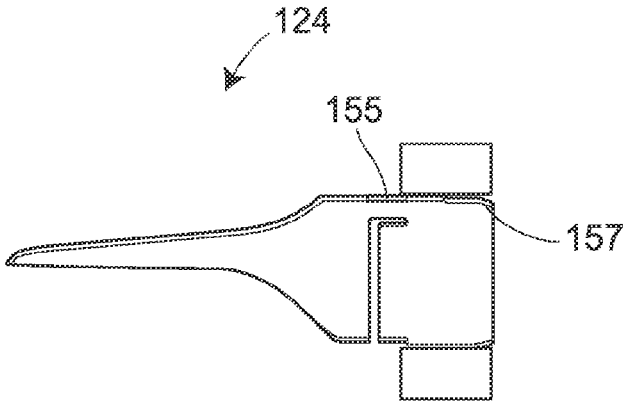
FIG. 19 is a close up side cross-sectional view of another alternate embodiment of a flexible cover.
Figure 20:
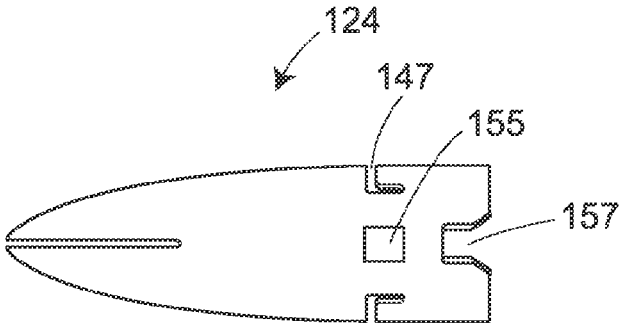
FIG. 20 is a close up top view of the flexible cover of FIG. 19.
Figure 21:
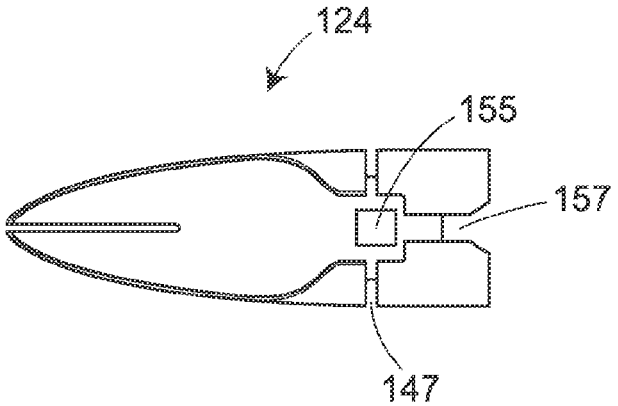
FIG. 21 is a bottom view of the flexible cover of FIG. 11.

FIGS. 19-21 illustrate yet another embodiment of the flexible cover 124. In this embodiment, the flexible cover comprises a pair of radial slits 147, a square hole 155, and a guiding slot 157. The radial slits 147 impart favorable flexibility characteristics along with favorable stress distribution along the flexible cover 124, while the square hole 155 provides stability to the writing tip assembly 116. More specifically, the square hole 155 may cooperate with a reciprocal feature on the inner sheath 117 (see FIGS. 26-28) to laterally or radially stabilize the writing tip assembly 116 during writing. The square hole 115 also axially or longitudinally stabilizes the writing tip assembly 116 during writing. Similarly, the guiding slot 157 may cooperate with a corresponding ridge on the inner sleeve or the cartridge (see, e.g., FIGS. 26-28) to align the flexible cover 124 on the inner sheath 117 (see FIG. 9).

Figure 22:
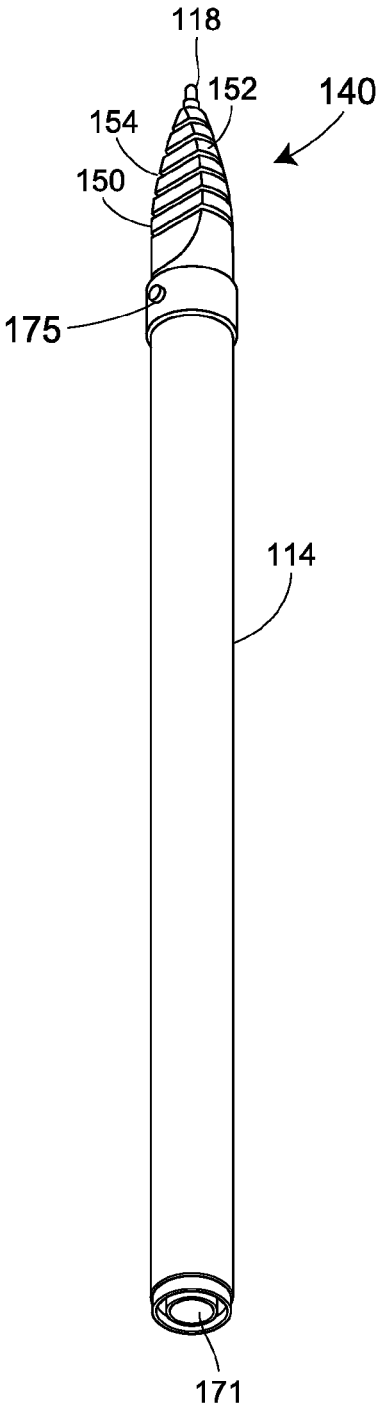
FIG. 22 is a perspective view of an ink cartridge of the writing instrument of FIGS. 6 and 7.
Figure 23:
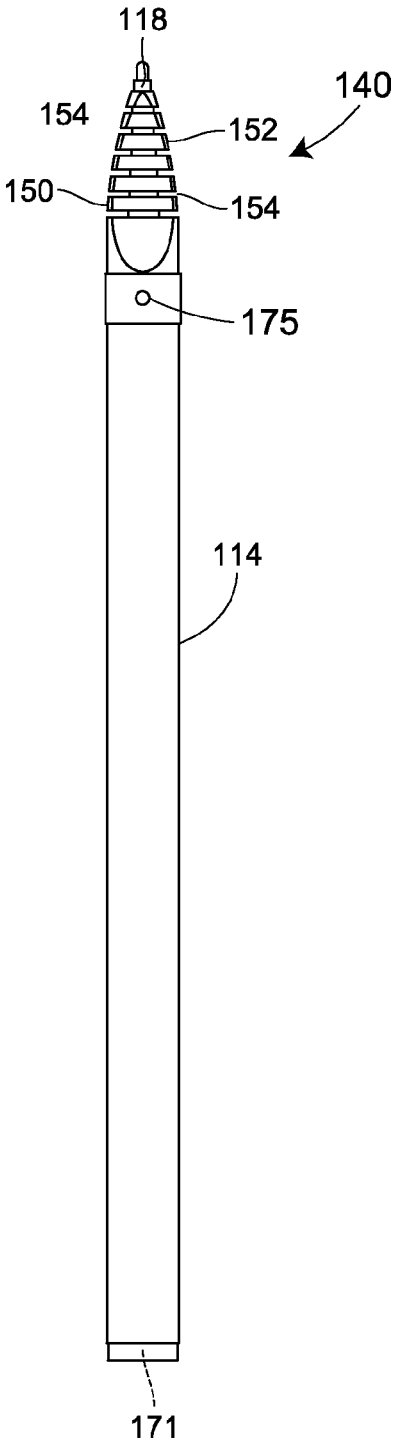
FIG. 23 is a top view of the ink cartridge of FIG. 22.

FIGS. 22 and 23 illustrate one embodiment of the removable cartridge 114. In this example, the ink delivery portion 140 and writing point 118 are integrally formed with the ink reservoir 171. As a result, the entire cartridge 114 may be removed from the writing instrument when the ink is depleted and a new cartridge may be inserted. While not shown in FIGS. 22 and 23, the flexible cover 124 may also be attached to the cartridge 114 in some embodiments. The cartridge 114 may include one or more alignment features, such as posts 175. The posts 175 may cooperate with a reciprocal alignment feature, such as a converging channel (see FIG. 25), in an inner surface of the inner sheath 117 to ensure proper alignment of the cartridge 114 within the barrel 112. In one embodiment, the converging channel may take on a generally funnel-shape.

Figure 24:
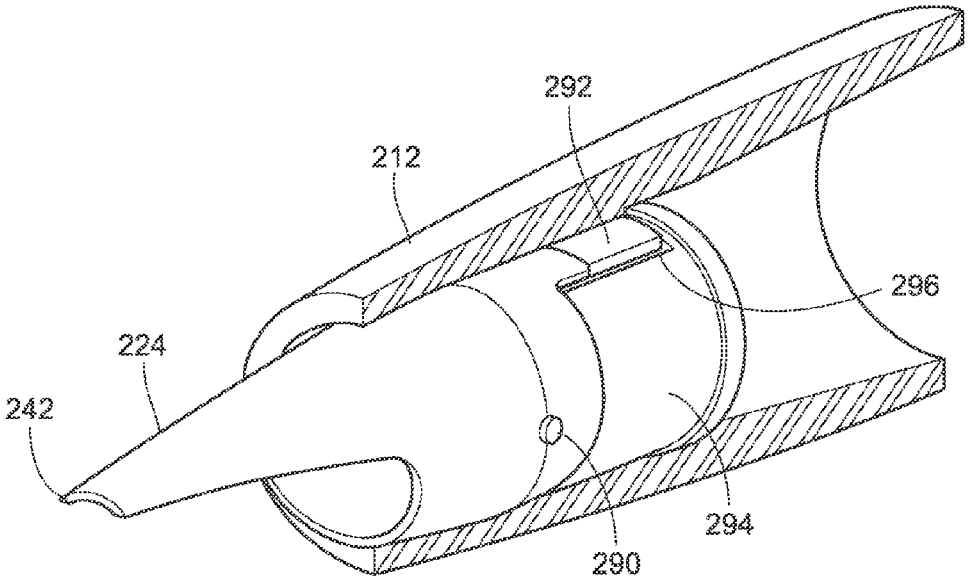
FIG. 24 is a perspective cut-away view of a rigid cover and a spring element that may be incorporated in other embodiments of the disclosed writing instrument.

FIG. 24 illustrates an alternate embodiment of a cover 224. In this example, the cover 224 takes the place of the flexible cover 24, 124 of earlier embodiments. The cover 224 differs from previously described covers in that the cover 224 is relatively rigid instead of flexible. The cover 224 is secured within the barrel 212 and the cover 224 is pivotable about a pivot point 290. Opposite the distal end 242 of the cover 224 (e.g., at a proximal end), a tab 292 extends away from the distal end 242. A spring element 294 is located behind the cover 224, the pivot point 290 being located between the spring element 294 and the distal end 242 of the cover 224. The spring element 294 includes a recess 296 sized and shaped to receive at least a portion of the tab 292. As the distal end 242 of the cover moves axially outward (e.g., when the writing tip is placed on a substrate), the tab 292 will move radially inward (i.e., opposite of the distal end 242 movement) due to the relative positions of the distal end 242, the pivot point 290, and the tab 292. The spring element 294, being made of an elastic material, will flex axially inward, due to the inward movement of the tab 292. However, the elastic properties of the spring element 294 will bias the tab 292 axially outward, which will bias the distal end 242 radially inward. As a result, the cover 224 will resist axial movement of the writing assembly, similar to the axial resistance provided by the flexible covers 24, 124 in previous embodiments. Thus, the cover 224 of FIG. 24 produces a fountain pen like resistance to axial movement during writing.

Figure 25:
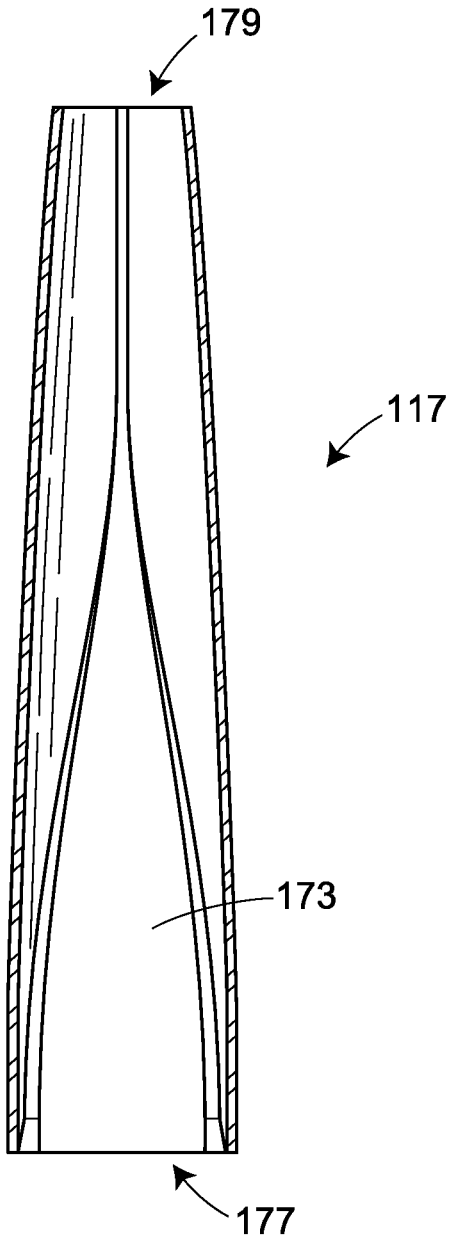
FIG. 25 is a longitudinal cross-sectional view of an inner sleeve of the writing instrument of FIGS. 8 and 9.

Turning now to FIG. 25, the inner sheath 117 is illustrated in more detail. More specifically, the inner sheath 117 may include a guiding feature, such as a converging channel 173 for guiding the posts 175 on the cartridge 114 into a correct position when the cartridge 114 is inserted into the inner sheath 117 from the back. The converging channel 173 is wider near a back end 177 of the inner sheath 117 than near a front end 179 of the inner sheath 117. The inner sheath 117 may include two converging channels 173 (only one is shown in FIG. 25) offset by approximately 180° from one another in the inner surface of the inner sheath 117.

Figure 26:
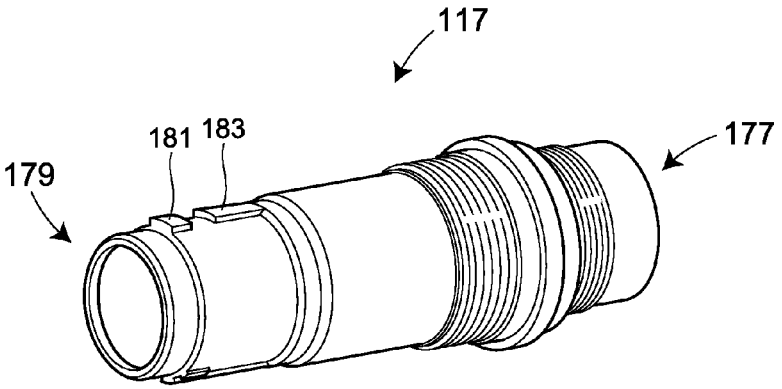
FIG. 26 is a perspective view of the inner sleeve of FIG. 25.
Figure 27:
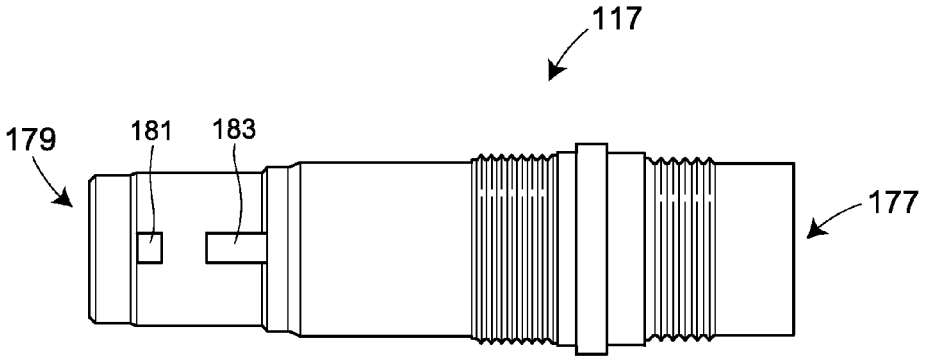
FIG. 27 is a top view of the inner sleeve of FIG. 25.
Figure 28:
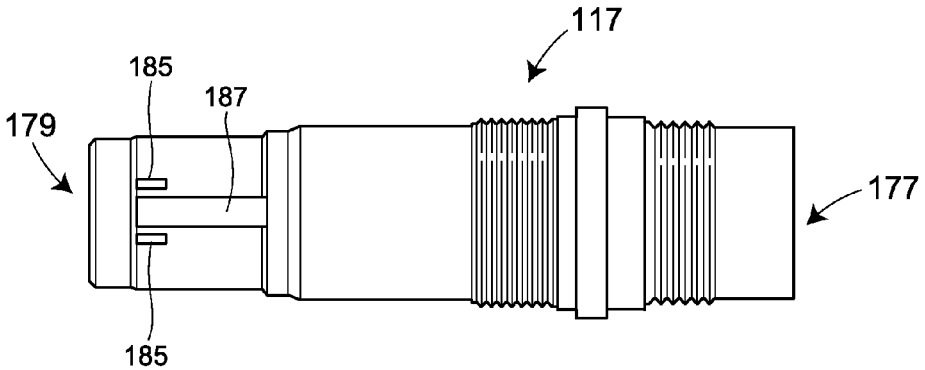
FIG. 28 is a bottom view of the inner sleeve of FIG. 25.

Turning now to FIGS. 26-28, an outer surface of the inner sheath 117 may include alignment features such as a square pillar 181 and a ridge 183. The square pillar 181 and/or ridge 183 may slope generally from front to back to allow easy installation of the cover 124 onto the inner sheath 117, while preventing unintentionally disengagement of the cover 124 from the inner sheath 117 once installed thereon. The square pillar 181 interacts with the square hole 155 (see FIG. 20) on the cover 124 to secure the cover 124 on the inner sheath 117. The ridge 183 interacts with the guiding slot 157 (see FIG. 20) to align the cover 124 on the inner sheath 117 and also to circumferentially stabilize the cover 124 on the inner sheath 117. Likewise, a bottom ridge 187 may be located between the two arms 172 (see FIG. 17) to provide additional alignment between the cover 124 and the inner sheath 117. Two rails 185 may be disposed on the outer surface of the inner sheath 117 opposite the square pillar 181. The two rails 185 lock the arms 172 longitudinally on the inner sheath 117, thus preventing the cover 124 from sliding off of the inner sheath 117 unintentionally.

Figure 29:
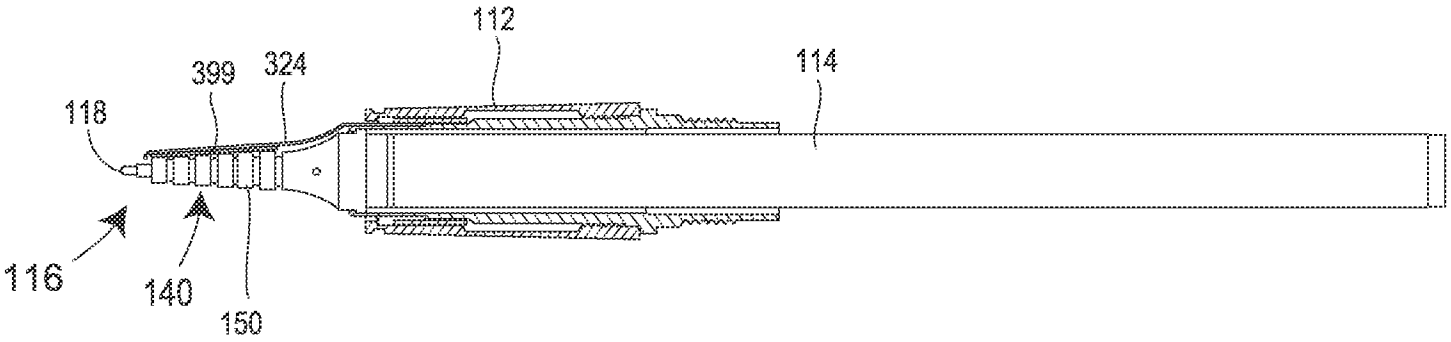
FIG. 29 is a side cross-sectional view of an alternate embodiment of a writing tip assembly and rigid cover that may be incorporated in other embodiments of the disclosed writing instrument.

FIG. 29 illustrates yet another embodiment of a writing instrument including a substantially rigid cover 324. In this embodiment, the substantially rigid cover 324 is secured to the barrel 112 or the cartridge 114. However, in contrast to the embodiment of FIG. 24, the substantially rigid cover 324 does not pivot. Rather, a flexible compression element 399 is disposed between the substantially rigid cover 324 and the writing tip assembly 116. The flexible compression element 399 is compressible in the radial direction to allow the writing tip assembly 116 to flex in the radial direction. As the flexible compression element 399 compresses when the writing assembly 116 flexes in the radial direction, the flexible compression element 399 provides resistance to the radial movement of the writing assembly 116 that mimics the feel of a fountain pen. The flexible compression element 399 may be made of foam, elastomeric material, as spring (such as a leaf spring), other resilient materials, or other resilient elements.

In other embodiments, the inner sheath 117 may be eliminated or integrated with the barrel 112 or cartridge 114 and structural features disclosed herein as being located on or in the inner sheath 117 may be relocated to either the barrel 112 or the cartridge 114. More specifically, in other embodiments, the converging channel 173 (FIG. 25) may be located on an inner surface of the barrel 112. Similarly, the square pillar 181, the ridge 183, the bottom ridge 187, and the rails 185 (FIGS. 26-28) may be located on an outer surface of the cartridge 114.

The features in the foregoing description, in the claims and/or in the accompanying drawings may, both and in any combination thereof, be material for realizing the invention in diverse forms thereof.

The invention claimed is:

1. A writing instrument, comprising:

a shell, an ink reservoir disposed in the shell, and a writing tip section that is provided on the shell, the writing tip section adapted for applying ink from the ink reservoir to a substrate, the writing tip section including a writing tip and an ink feed assembly adapted for delivering ink from the ink reservoir to the writing tip through capillary action by way of a capillary ink feed duct, wherein the writing tip is flexible and a flexible cover with the shape of a fountain pen nib is provided for supporting the flexible writing tip, and the capillary ink feed duct forms an enclosed pathway which extends from the ink reservoir to the writing tip.

2. The writing instrument according to claim 1, wherein the flexible writing tip is made of plastic.

3. The writing instrument according to claim 1, wherein the flexible cover is made of metal or plastic.

4. The writing instrument according to claim 1, wherein the flexible cover is flexible in a radial direction.

5. The writing instrument according to claim 1, wherein the ink reservoir is defined by an ink cartridge and the ink cartridge is part of a removable unit.

6. The writing instrument according to claim 5, further comprising a spring element in the shell behind the removable unit for spring-biasing movement of the removeable unit in and out axially within the shell.

7. The writing instrument according to claim 5, wherein the writing tip is part of the ink cartridge.

8. The writing instrument according to claim 1, wherein the flexible cover is part of the shell.

9. The writing instrument according to claim 1, wherein the flexible writing tip with the flexible cover or the writing tip section with the flexible cover is part of a removable unit.

10. A writing instrument comprising:

a barrel having an opening at one end, the barrel having a hollow chamber, the hollow chamber having an ink reservoir disposed therein;

a flexible writing tip assembly adapted for providing fluid communication from the ink reservoir to a writing point, the flexible writing tip assembly being disposed at least partially in the opening, the flexible writing tip assembly including an ink channel adapted for transmitting ink from the ink reservoir to the writing point, an inner sleeve surrounding the ink channel, and a flexible outer sleeve surrounding the inner sleeve, the flexible outer sleeve being coupled to the barrel; and a writing tip cover proximate the opening and extending along a portion of the flexible writing tip assembly, the writing tip cover resisting radial movement of the flexible writing tip assembly, wherein the ink channel forms an enclosed pathway which extends from the ink reservoir to the writing point.

11. The writing instrument of claim 10, wherein the flexible outer sleeve is formed by a plurality of radial segments, each radial segment being separated from another radial segment by a gap.

12. The writing instrument of claim 11, wherein a radial segment proximal to the writing point has a smaller radial size than a radial segment distal to the writing point.

13. The writing instrument of claim 11, wherein gaps between individual segments in the plurality of radial segments vary in size, a smaller gap being located distal to the writing point and a larger gap being located proximate to the writing point.

14. The writing instrument claim 10, wherein the writing tip cover is pivotably mounted to one of the barrel and the flexible writing tip assembly.

15. The writing instrument of claim 10, further comprising a spring element disposed between the writing tip cover and the ink reservoir.

16. The writing instrument of claim 10, wherein the writing tip cover has a distal end and a proximal end, and the writing tip cover includes a tab formed on the proximal end.

17. The writing instrument of claim 16, wherein the spring element includes a recess sized and shaped to receive the tab.

18. The writing instrument of claim 10, further comprising a flexible compression element disposed between the flexible writing tip assembly and the writing tip cover.

19. The writing instrument of claim 10, wherein the writing tip cover is cantileverly mounted to one of the barrel and the writing tip assembly.

20. The writing instrument of claim 10, wherein the writing tip cover has the shape of a fountain pen nib.

21. The writing instrument of claim 10, wherein the writing point is selected from the group consisting of a porous point, and a ball point.

* * * * *